US008722597B2

(12) United States Patent
Tatsumi et al.

(10) Patent No.: US 8,722,597 B2
(45) **Date of Patent: *May 13, 2014**

(54) LUBRICATING OIL COMPOSITION FOR INTERNAL COMBUSTION ENGINE

(75) Inventors: Yukio Tatsumi, Tokyo (JP); Kenji Yamamoto, Tokyo (JP)

(73) Assignee: Adeka Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/635,037

(22) PCT Filed: May 18, 2011

(86) PCT No.: PCT/JP2011/061413

§ 371 (c)(1),
(2), (4) Date: Sep. 14, 2012

(87) PCT Pub. No.: WO2011/158595

PCT Pub. Date: Dec. 22, 2011

(65) Prior Publication Data

US 2013/0012418 A1 Jan. 10, 2013

(30) Foreign Application Priority Data

Jun. 15, 2010 (JP) ..... 2010-136278

(51) Int. Cl.

| | |
|---|---|
| ***C10M 137/10*** | (2006.01) |
| ***C07F 9/02*** | (2006.01) |
| ***C07F 9/06*** | (2006.01) |
| ***C07F 9/09*** | (2006.01) |

(52) U.S. Cl.
USPC ..... 508/423; 508/364; 508/369; 558/162

(58) Field of Classification Search
USPC ..... 508/364, 423, 369; 558/162
See application file for complete search history.

(56) References Cited

U.S. PATENT DOCUMENTS

| | | | |
|---|---|---|---|
| 3,492,373 | A | 1/1970 | Matson et al. |
| 5,344,468 | A | 9/1994 | Hanlon et al. |
| 5,560,849 | A | 10/1996 | Shankwalkar et al. |
| 6,245,725 | B1 | 6/2001 | Tanaka et al. |

FOREIGN PATENT DOCUMENTS

| | | |
|---|---|---|
| CN | 1611590 | 5/2005 |
| EP | 0 521 628 | 1/1993 |
| EP | 0 612 837 | 8/1994 |
| JP | 5-194559 | 8/1993 |
| JP | 6-80981 | 3/1994 |
| JP | 2000-192068 | 7/2000 |
| JP | 2001-262172 | 9/2001 |
| JP | 2004-51758 | 2/2004 |
| JP | 2006-131766 | 5/2006 |
| WO | 96/20263 | 7/1996 |

OTHER PUBLICATIONS

International Search Report issued Aug. 9, 2011 in International (PCT) Application No. PCT/JP2011/061413.
Chinese Office Action issued Dec. 9, 2013 in corresponding Chinese Application No. 201180029447.6.
Supplementary European Search Report mailed Nov. 6, 2013 in corresponding European Application No. 11 79 5503.

*Primary Examiner* — Vishal Vasisth
(74) *Attorney, Agent, or Firm* — Wenderoth, Lind & Ponack, L.L.P.

(57) ABSTRACT

Provided is a lubricating oil composition for an internal combustion engine, including as essential components the following component (A), component (B), and component (C), in which a phosphorus content of the composition is 50 ppm by mass to 1,000 ppm by mass: Component (A): a base oil; Component (B): a compound represented by the following general formula (1); and Component (C): a metal-containing antioxidant:

[Chem. 1]

(1)

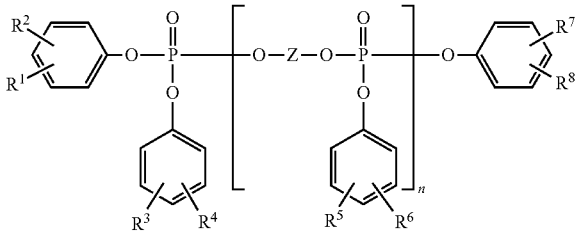

where $R^1$ to $R^8$ each independently represent a hydrogen atom or an alkyl group having 1 to 20 carbon atoms, Z represents a hydrocarbon group having 2 to 20 carbon atoms, and n represents a number of 1 to 10.

7 Claims, No Drawings

LUBRICATING OIL COMPOSITION FOR INTERNAL COMBUSTION ENGINE

This application is a 371 of PCT/JP2011/061413, filed May 18, 2011.

TECHNICAL FIELD

The present invention relates to a lubricating oil composition for an internal combustion engine capable of providing both satisfactory oxidation-preventing and wear-preventing effects, and having a reduced phosphorus content.

BACKGROUND ART

Heretofore, a phosphorus-containing compound has been generally used both an anti-wear agent and an antioxidant to be used in engine oils, diesel oils, or the like for internal combustion engines. A large number of manufacturers have dealt with the need for such anti-wear agent and antioxidant by combining an organic zinc compound or an organic molybdenum compound with an additive (for example, Patent Documents 1 to 3).

Patent Document 1 discloses a lubricating oil composition for an internal combustion engine characterized by containing, with respect to a lubricating oil base oil (a mineral oil or a synthetic oil), 0.01 to 0.2 wt % in terms of a molybdenum (Mo) amount of sulfurized oxymolybdenum dithiocarbamate, 0.01 to 0.2 wt % in terms of a phosphorus (P) amount of zinc dithiophosphate, and 0.2 to 5 wt % of a phenol-based antioxidant having an ester group.

In addition, Patent Document 2 discloses a diesel engine oil for an engine with an exhaust gas recirculation apparatus, the oil being characterized in that a lubricating oil base oil (a mineral oil or a synthetic oil) is blended with 5.8 to 8.3 mass % of a calcium alkyl salicylate (calcium (Ca) content: 6.0 mass %) having a total basic number (TBN) of 165 mgKOH/g as a detergent, 0.09 to 0.13 mass % in terms of zinc (Zn) of a primary alkyl-type zinc dithiophosphate as an antioxidant-cum-anti-wear agent, and 0.02 to 0.04 mass % in terms of molybdenum (Mo) of an oil-soluble oxymolybdenum dialkyl dithiophosphate as a friction modifier-cum-anti-wear agent.

Further, Patent Document 3 discloses a lubricating oil composition for an internal combustion engine characterized in that a base oil formed of a mineral oil and/or a synthetic oil is blended with (A) 0.08 to 0.40 mass % in terms of a nitrogen element of a succinimide-based ashless dispersant, (B) 0.06 to 0.22 mass % in terms of a metal element of a metal-based detergent, (C) 0.04 to 0.08 mass % in terms of a phosphorus element of a secondary alkyl zinc dithiophosphate, and (D) 0.01 to 0.04 mass % in terms of a phosphorus element of a phosphorus-containing ashless anti-wear agent, and that the content of sulfated ash derived from a metal element in the composition is 0.3 to 1.0 mass %. The document also discloses a lubricating oil composition for an internal combustion engine characterized by being blended with 0.01 to 0.04 mass % in terms of a phosphorus element of a phosphorus-containing ashless anti-wear agent, and characterized in that the content of sulfated ash derived from a metal element in the composition is 0.3 to 1.0 mass %.

PRIOR ART DOCUMENTS

Patent Documents

Patent Document 1: JP 10-17883 A
Patent Document 2: JP 07-207290 A
Patent Document 3: JP 2003-165992 A

SUMMARY OF THE INVENTION

Problem to be Solved by the Invention

Meanwhile, a phosphorus compound may adversely affect the environment and an exhaust gas-purifying catalyst for an automobile, and hence a reduction of the phosphorus content in a lubricating oil for an internal combustion engine is sought in the GF-3 standard (introduced in July 2001) and the GF-4 standard (introduced in July 2004) by the International Lubricant Standardization and Approval Committee (ILSAC).

However, current engines operate at high speed in many cases and a lubricating oil to be used therein has a low viscosity. Accordingly, such circumstances that wear must be prevented in an extremely strict fashion have been established. Therefore, the wear-preventing effect on such high-performance engines may not be satisfied by merely reducing the phosphorus content of such lubricating oil composition for an internal combustion engine as described above. In view of the foregoing, the following lubricating oil composition for an internal combustion engine is being sought. The composition can provide both satisfactory oxidation-preventing and wear-preventing effects even when its phosphorus content is reduced, and the composition has such high wear-preventing performance as to be capable of conforming to high-performance engines.

Therefore, a problem to be solved by the present invention is to provide a lubricating oil composition for an internal combustion engine capable of providing both satisfactory oxidation-preventing and wear-preventing effects even when its phosphorus content is reduced.

Means for Solving the Problem

In view of the foregoing, the inventors of the present invention as a result of intensive study, have achieved the present invention.

That is, the present invention is a lubricating oil composition for an internal combustion engine, including as essential components the following component (A), component (B), and component (C), in which a phosphorus content of the composition is 50 ppm by mass to 1,000 ppm by mass:

Component (A): a base oil;

Component (B): a compound represented by the following general formula (1); and

Component (C): a metal-containing antioxidant:

[Chem. 1]

(1)

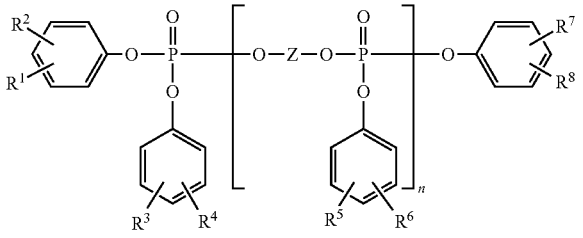

where $R^1$ to $R^8$ each independently represent a hydrogen atom or an alkyl group having 1 to 20 carbon atoms, Z represents a hydrocarbon group having 2 to 20 carbon atoms, and n represents a number from 1 to 10.

Effects of the Invention

An effect of the present invention lies in the fact that a lubricating oil composition for an internal combustion engine exerting an oxidation-preventing effect and a wear-preventing effect even when its phosphorus content is reduced as compared to a conventionally known lubricating oil composition for an internal combustion engine has been provided.

BEST MODE FOR CARRYING OUT THE INVENTION

A base oil that can be used as the component (A) of a lubricating oil composition for an internal combustion engine of the present invention is a mineral oil, a synthetic oil, or a mixture thereof. The kinematic viscosity of the base oil, which is not particularly limited, is preferably 1 to 50 $mm^2$/sec at 100° C., and is preferably about 10 to 1,000 $mm^2$/sec at 40° C. Its viscosity index (VI) is preferably 100 or more, more preferably 120 or more, most preferably 135 or more.

The mineral oil that can be used as the component (A) is separated from a natural crude oil, and is produced by properly subjecting the crude oil to distillation, purification, or the like. The main component of the mineral oil is a hydrocarbon (any one of the paraffins in many cases), and the mineral oil contains a one-ring naphthene component, a two-ring naphthene component, an aromatic component, or the like in addition to the main component. A base oil obtained by subjecting those components to purification such as hydrogenation purification, solvent deasphalting, solvent extraction, solvent dewaxing, hydrogenation dewaxing, contact dewaxing, hydrocracking, alkali distillation, sulfuric acid washing, or a clay treatment can also be preferably used. Such purifying measures are taken in an appropriate combination, and it is also effective to repeatedly perform the same treatment in a plurality of stages. For example, such a method as described below is effective: (i) a method involving subjecting a distillate oil to a solvent extraction treatment, or subjecting the distillate oil to a solvent extraction treatment and then to a hydrogenation treatment, and subjecting the treated oil to sulfuric acid washing; (ii) a method involving subjecting a distillate oil to a hydrogenation treatment and then to a dewaxing treatment; (iii) a method involving subjecting a distillate oil to a solvent extraction treatment and then to a hydrogenation treatment; (iv) a method involving subjecting a distillate oil to a solvent extraction treatment and then to a clay treatment; (v) a method involving subjecting a distillate oil to a hydrogenation treatment in two or three or more stages, and optionally subjecting the treated oil to an alkali distillation or sulfuric acid washing treatment after the hydrogenation treatment; (vi) a method involving subjecting a distillate oil to a hydrogenation treatment, or subjecting the distillate oil to a hydrogenation treatment and then to an alkali distillation or sulfuric acid washing treatment; or a method involving mixing these treated oils.

An aromatic component, a sulfur content, a nitrogen content, or the like in an unpurified mineral oil can be removed by performing any such treatment. Although those impurities can each be removed to trace amounts or less by current technology, the aromatic component is made to remain at about 3 mass % to 5 mass % in some cases because the component has such an effect as to make a lubricating oil additive easily soluble. For example, the sulfur content or nitrogen content in a highly purified mineral oil that has been currently used is 0.01 mass % or less, and is 0.005 mass % or less in some cases. On the other hand, the aromatic component remains at 1 mass % or less, and in some cases, 0.05 mass % or less in some mineral oils each while the component remains at about 3 mass % in other mineral oils each.

A commercially available mineral oil is, for example, a paraffin-based mineral oil subjected to any such treatment as described above or a naphthene-based mineral oil containing a large amount of a naphthene component.

Further, the synthetic oil which may be used as the component (A) is a chemically synthesized lubricating oil and examples thereof include a poly-α-olefin, an ethylene-α-olefin copolymer, polyisobutylene (polybutene), a monoester, a hindered ester, a diester, an aromatic polyhydric carboxylic acid ester, a silicic acid ester, a polyalkylene glycol, polyphenyl ether, silicone, a fluorocompound, an alkylbenzene, GTL and the like.

Examples of the poly-α-olefin include polymerized or oligomerized products of 1-hexene, 1-octene, 1-nonene, 1-decene, 1-dodecene, and 1-tetradecene, or hydrogenated products thereof. An ester obtained from any appropriate monocarboxylic acid and any appropriate monoalcohol may be used as the monoester. As the monocarboxylic acid, a monocarboxylic acid having 6 to 20 carbon atoms is preferred, a monocarboxylic acid having 6 to 12 carbon atoms is more preferred, and a monocarboxylic acid having 8 carbon atoms is even more preferred. As the monoalcohol, an alcohol having an alkyl group having 6 to 20 carbon atoms is preferably used. Examples of the diester include a diester of a dibasic acid such as glutaric acid, adipic acid, azelaic acid, sebacic acid, or dodecanedioic acid and an alcohol such as 2-ethylhexanol, octanol, decanol, dodecanol, or tridecanol. Examples of the hindered ester include an ester of a polyol such as neopentyl glycol, trimethylolethane, trimethylolpropane, glycerine, pentaerythritol, sorbitol, dipentaerythritol, tripentaerythritol, or an alkylene oxide adduct thereof and a fatty acid such as butyric acid, isobutyric acid, valeric acid, isovaleric acid, pivalic acid, capric acid, caproic acid, caprylic acid, lauric acid, myristic acid, palmitic acid, stearic acid, or oleic acid. Examples of the polyalkylene glycol include polyethylene glycol, polypropylene glycol, polyethylene glycol monomethyl ether, and a mono- or dimethyl ether of a block or random copolymer of ethylene oxide/propylene oxide.

Those synthetic oils are each a single substance or a mixture of homologues because the oils are each chemically synthesized. Therefore, a synthetic oil such as a poly-α-olefin, a polyisobutylene (polybutene), a diester, a polyol ester, or a polyalkylene glycol is free of impurities in a mineral oil, e.g., an aromatic component such as benzene or a polycondensed compound, a sulfur content such as thiophene, and a nitrogen content such as indole or carbazole.

Of those mineral oils and synthetic oils, a poly-α-olefin, a paraffin-based mineral oil, and a naphthene-based mineral oil are preferably used because of their high wear-alleviating effects.

The component (B) of the lubricating oil composition for an internal combustion engine of the present invention is a compound represented by the following general formula (1).

[Chem. 2] (1)

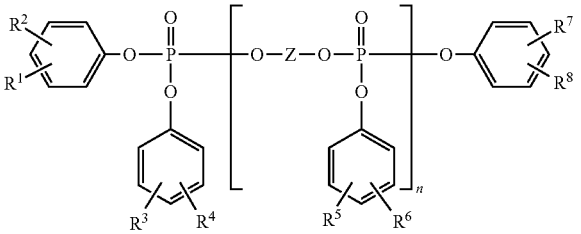

where $R^1$ to $R^8$ each independently represent a hydrogen atom or an alkyl group having 1 to 20 carbon atoms, Z represents a hydrocarbon group having 2 to 20 carbon atoms, and n represents a number from 1 to 10.

In the general formula (1), $R^1$ to $R^8$ each independently represent a hydrogen atom or an alkyl group having 1 to 20 carbon atoms. Examples of such alkyl group include a methyl group, an ethyl group, a propyl group, an isopropyl group, a butyl group, an isobutyl group, a secondary butyl group, a tertiary butyl group, a pentyl group, an amyl group, an isoamyl group, a hexyl group, a heptyl group, an isoheptyl group, an octyl group, an isooctyl group, a 2-ethylhexyl group, a nonyl group, an isononyl group, a decyl group, a dodecyl(lauryl) group, a tridecyl group, a tetradecyl(myristyl) group, a pentadecyl group, a hexadecyl(palmityl) group, a heptadecyl group, an octadecyl(stearyl) group, a nonadecyl group, and an icosyl group. $R^1$ to $R^8$ each preferably represent a hydrogen atom or a methyl group because of its high wear-preventing effect.

In the general formula (1), Z represents a hydrocarbon group having 2 to 20 carbon atoms. Examples of such group include an alkylene group, a cycloalkylene group, an arylene group, and a hydrocarbon group formed of an arylene group and an alkylene group. Examples of the alkylene group include an ethylene group, a propylene group, a butylene group, a pentylene group, a hexylene group, a heptylene group, an octylene group, a nonylene group, a decylene group, an undecylene group, a dodecylene group, a tetradecylene group, a hexadecylene group, an octadecylene group, and an icosylene group.

Examples of the cycloalkylene group include a cyclopropylene group, a cyclobutylene group, a cyclopentylene group, a cyclohexylene group, a cycloheptylene group, a cyclooctylene group, dicyclopentylene group, and a tricyclopentylene group.

Examples of the arylene group include a group represented by a general formula (6), a group represented by a general formula (8), and a naphthylene group. In the case of the group represented by the general formula (6), three structures, i.e., an ortho body, a meta body, and a Para body are obtained depending on bonding sites. Any one of the structures is permitted, and the structural difference does not lead to a change in performance. Examples of the hydrocarbon group formed of an arylene group and an alkylene group include a group represented by a general formula (7) and a 1,2-diphenylethylene group. Z preferably represents a group containing one or more arylene groups out of those groups because a wear-preventing effect is high. Z represents more preferably the group represented by any one of the general formula (6), the general formula (7), and the general formula (8), still more preferably the group represented by one of the general formula (6) and the general formula (7).

[Chem. 3]

(6)

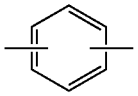

(7)

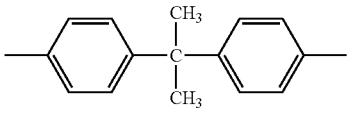

-continued (8)

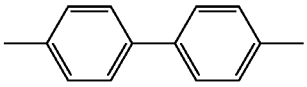

In the compound represented by the general formula (1), n is a number from 1 to 10 and represents a degree of polymerization, and is preferably a number from 1 to 5 in order that the compound as the component (B) of the lubricating oil composition for an internal combustion engine of the present invention may be caused to sufficiently exert its wear-preventing effect.

A compound where n of the compound represented by the general formula (1) is zero or a compound where n is 11 or more are included as impurities in the component (B) in some cases. The content of such impurity is preferably 10 parts by mass or less, more preferably 5 parts by mass or less, still more preferably 2 parts by mass or less with respect to 100 parts by mass of the component (B). A content in excess of 10 parts by mass is not preferred because it reduces the wear-preventing effect of the component (B).

In addition, the average of n, i.e., an average degree of polymerization is calculated from the molar ratio of the compound represented by the general formula (1). In the case of, for example, such composition that the molar ratio of a compound in which n=1 is 50 mol % and the molar ratio of a compound in which n=2 is 50 mol %, the average degree of polymerization is 1.5. It should be noted that a value for n can be calculated from the result of high-performance liquid chromatography measurement.

The average of n of the compound represented by the general formula (1) as the component (B), i.e., the average degree of polymerization, which is not particularly limited, is preferably 1.0 to 4.0 in order that the wear-preventing effect may be improved, and is more preferably 1.0 to 2.0. An average degree of polymerization in excess of 4.0 is not preferred because the compound may be hard to dissolve in the component (A) or the wear-preventing effect may be reduced. It should be noted that when such a compound where n in the general formula (1) represents zero or such a compound where n represents 11 or more is included, a value for n of such compound is not factored into the calculation of the average of n of the component (B) of the present invention, i.e., the average degree of polymerization.

A method of producing the compound represented by the general formula (1) is not particularly limited and any one of the known methods may be employed. The target product can be obtained by, for example, one of the following methods.

Method 1

When a compound wherein Z is represented by the general formula (6), all of $R^1$ to $R^8$ represent hydrogen atoms, and the value for n in the general formula (1) ranges from 1 to 5 is produced, said compound can be obtained by reacting 1 mol of 1,3-benzenediol with 2 mol of phosphorus oxychloride, and then reacting the obtained product with 4 mol of phenol. In this case, compounds having different values for n can be produced by changing the molar ratio of each raw material. At whatever molar ratio the synthesis may be performed, a mixture of compounds having different values for n is typically obtained unless purification is performed.

Method 2

When a compound wherein Z is represented by the general formula (6), all of $R^1$ to $R^8$ represent hydrogen atoms, and the value for n in the general formula (1) is 1 is produced, the compound is obtained by reacting 1 mol of 1,3-benzenediol with 2 mol of diphenyl chlorophosphate.

In addition, one kind of components (B) may be used alone, or two or more kinds thereof may be used in combination.

The component (C) of the lubricating oil composition for an internal combustion engine of the present invention is a metal-containing antioxidant. The metal-containing antioxidant shows not only an oxidation-preventing effect but also a wear-preventing effect. In addition, the oxidation-preventing effect is known to be synergistically improved when the antioxidant is used in combination with a nonmetallic antioxidant such as a phenol-based antioxidant or an amine-based antioxidant. Examples of such metal-containing antioxidant include zinc dithiophosphate, zinc dithiocarbamate, molybdenum dithiocarbamate, molybdenum dithiophosphate, molybdenum amine, copper dithiophosphate, and copper dithiocarbamate. Of those, a zinc dithiophosphate represented by a general formula (2), a molybdenum dithiocarbamate represented by a general formula (3), a molybdenum dithiophosphate represented by a general formula (4), and a molybdenum amine obtained by causing a hexavalent molybdenum compound and a primary or secondary amine represented by a general formula (5) to react with each other are preferred because of their high wear-preventing effects and high oxidation-preventing effects. The zinc dithiophosphate represented by the general formula (2) and the molybdenum dithiocarbamate represented by the general formula (3) are more preferred, and the zinc dithiophosphate represented by the general formula (2) is still more preferred.

First, the zinc dithiophosphate represented by the general formula (2) is described.

[Chem. 4]

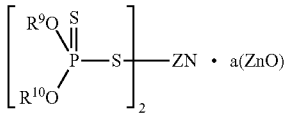

(2)

where $R^9$ and $R^{10}$ each represent a hydrocarbon group having 1 to 20 carbon atoms, and a represents a number from 0 to 1/3.

In the general formula (2), $R^9$ and $R^{10}$ each represent a hydrocarbon group having 1 to 20 carbon atoms. Examples of the hydrocarbon group include an alkyl group, an alkenyl group, an aryl group, a cycloalkyl group, and a cycloalkenyl group.

Examples of the alkyl group include the groups described above in the general formula (1). Examples of the alkenyl group include a vinyl group, an aryl group, a propenyl group, an isopropenyl group, a butenyl group, an isobutenyl group, a pentenyl group, an isopentenyl group, a hexenyl group, a heptenyl group, an octenyl group, a nonenyl group, a decenyl group, an undecenyl group, a dodecenyl group, a tetradecenyl group, a tridecenyl group, a pentadecenyl group, a hexadecenyl group, a heptadecenyl group, an octadecenyl group, a nonadecenyl group, and an icosenyl group.

Examples of the aryl group include a phenyl group, a toluoyl group, a xylyl group, a cumenyl group, a mesityl group, a benzyl group, a phenethyl group, a styryl group, a cinnamyl group, a benzhydryl group, a trityl group, an ethylphenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, a dodecylphenyl group, a styrenated phenyl group, a p-cumylphenyl group, a phenylphenyl group, a benzylphenyl group, an α-naphthyl group, and a β-naphthyl group.

Examples of the cycloalkyl group and the cycloalkenyl group include a cyclopentyl group, a cyclohexyl group, a cycloheptyl group, a methylcyclopentyl group, a methylcyclohexyl group, a methylcycloheptyl group, a cyclopentenyl group, a cyclohexenyl group, a cycloheptenyl group, a methylcyclopentenyl group, a methylcyclohexenyl group, and a methylcycloheptenyl group.

In the general formula (2), $R^9$ and $R^{10}$ each represent preferably an alkyl group, more preferably a secondary alkyl group. The number of carbon atoms of such group is preferably 3 to 14, more preferably 3 to 10, still more preferably 3 to 8. $R^9$ and $R^{10}$ may represent the same hydrocarbon group, or may represent different hydrocarbon groups.

In addition, when a=0 in the general formula (2), the zinc dithiophosphate is called a neutral zinc dithiophosphate (neutral salt). When a represents 1/3, the zinc dithiophosphate is called a basic zinc dithiophosphate (basic salt). As the zinc dithiophosphate is a mixture of such neutral salt and basic salt, a is represented by a number from 0 to 1/3. Although the value for a varies depending on a production method for the zinc dithiophosphate, a represents preferably 0.01 to 0.3, more preferably 0.01 to 0.25, still more preferably 0.03 to 0.2. When a represents more than 0.3, the hydrolysis stability of the composition may deteriorate. When a represents less than 0.01, the wear resistance of the lubricating oil composition for an internal combustion engine may deteriorate.

Next, the molybdenum dithiocarbamate represented by the general formula (3) is described.

[Chem. 5]

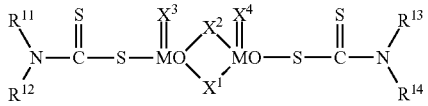

(3)

where $R^{11}$ to $R^{14}$ each represent a hydrocarbon group having 1 to 20 carbon atoms, and $X^1$ to $X^4$ each represent a sulfur atom or an oxygen atom.

In the general formula (3), $R^{11}$ to $R^{14}$ each represent a hydrocarbon group having 1 to 20 carbon atoms, and examples thereof include an alkyl group, an alkenyl group, an aryl group, a cycloalkyl group, and a cycloalkenyl group. Examples of the alkyl group, the alkenyl group, the aryl group, the cycloalkyl group, and the cycloalkenyl group include the groups described above for the general formula (1) and the general formula (2). It should be noted that $R^{11}$ to $R^{14}$ each represent preferably an alkyl group or an alkenyl group, more preferably an alkyl group. When the number of carbon atoms of the group is excessively small, the solubility of the molybdenum dithiocarbamate in the component (A) becomes poor. When the number of carbon atoms is excessively large, its melting point increases and its activity reduces. Accordingly, an alkyl group having 6 to 18 carbon atoms is preferred, an alkyl group having 8 to 15 carbon atoms is more preferred, and an alkyl group having 8 to 13 carbon atoms is still more preferred. Although $R^{11}$ to $R^{14}$ may be identical to or different from one another, $R^{11}$ to $R^{14}$ are preferably different from one another in order that the lubricating oil composition for an internal combustion engine of the present invention may be made long-drain.

In addition, in the general formula (3), $X^1$ to $X^4$ each represent a sulfur atom or an oxygen atom, and all of $X^1$ to $X^4$ may represent sulfur atoms or oxygen atoms, or the four $X^1$ to $X^4$ may represent a mixture of a sulfur atom and an oxygen atom. However, in consideration of lubricity and corrosion resistance, an abundance ratio of sulfur atoms to oxygen atoms is particularly preferably 1/3 to 3/1.

Next, the molybdenum dithiophosphate represented by the general formula (4) is described.

[Chem. 6]

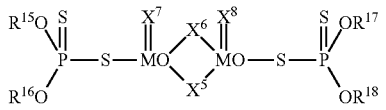

(4)

where $R^{15}$ to $R^{18}$ each represent a hydrocarbon group having 1 to 20 carbon atoms, and $X^5$ to $X^8$ each represent a sulfur atom or an oxygen atom.

In the general formula (4), $R^{15}$ to $R^{18}$ each represent a hydrocarbon group having 1 to 20 carbon atoms, and examples thereof include an alkyl group, an alkenyl group, an aryl group, a cycloalkyl group, and a cycloalkenyl group. Examples of the alkyl group, the alkenyl group, the aryl group, the cycloalkyl group, and the cycloalkenyl group include the groups described above for the general formula (1) and the general formula (2). $R^{15}$ to $R^{18}$ each represent preferably an alkyl group or an alkenyl group, more preferably an alkyl group. When the number of carbon atoms of the group is excessively small, the solubility of the molybdenum dithiophosphate in the component (A) becomes poor. When the number of carbon atoms is excessively large, its melting point increases and its activity is reduced. Accordingly, an alkyl group having 6 to 13 carbon atoms is preferred. This is because of the following reasons. When the number of carbon atoms is excessively small, the molybdenum dithiocarbamate becomes poor in oil solubility. When the number of carbon atoms is excessively large, its melting point increases to deteriorate its handleability, and its activity is reduced.

In the general formula (4), $X^5$ to $X^8$ each represent a sulfur atom or an oxygen atom, and all of $X^5$ to $X^8$ may represent sulfur atoms or oxygen atoms, or $X^5$ to $X^8$ may represent a mixture of sulfur atoms and oxygen atoms. However, in consideration of the lubricity and the corrosion resistance, the abundance ratio of sulfur atoms to oxygen atoms is particularly preferably 1/3 to 3/1.

The molybdenum amine is a product obtained by causing the hexavalent molybdenum compound and the primary or secondary amine represented by the following general formula (5) to react with each other.

$$R^{19}—NH—R^{20} \quad (5)$$

where $R^{19}$ and $R^{20}$ represent a hydrogen atom and/or a hydrocarbon group having 1 to 40 carbon atoms, provided that the case where $R^{19}$ and $R^{20}$ simultaneously represent hydrogen atoms is excluded.

In the general formula (5), $R^{19}$ and $R^{20}$ represent a hydrogen atom and/or a hydrocarbon group having 1 to 40 carbon atoms, and examples of such hydrocarbon group include an alkyl group, an alkenyl group, an aryl group, a cycloalkyl group, and a cycloalkenyl group.

Examples of the alkyl group include the alkyl groups described above in the general formula (1), a heneicosyl group, a docosyl group, a tricosyl group, a tetracosyl group, and a pentacosyl group. Examples of the alkenyl group include the alkenyl groups described above in the general formula (2), a henicosenyl group, a heneicosenyl group, a docosenyl group, a tricosenyl group, a tetracosenyl group, a pentacosenyl group, a triacotenyl group, and a triacontyl group. Examples of the aryl group and the cycloalkyl group include the groups described above in the general formula (2).

It should be noted that the case where $R^{19}$ and $R^{20}$ simultaneously represent hydrogen atoms is excluded. Both $R^{19}$ and $R^{20}$ each preferably represent a hydrocarbon group, more preferably an alkyl group, an alkenyl group, or an aryl group, still more preferably an alkyl group, alkenyl group, or aryl group having 8 to 18 carbon atoms.

Examples of the hexavalent molybdenum compound include molybdenum trioxide or a hydrate thereof ($MoO_3.nH_2O$), molybdic acid ($H_2MoO_4$), a molybdic acid alkali metal salt ($M_2MoO_4$), ammonium molybdate $\{(NH_4)_2MoO_4$ or $(NH_4)_6[Mo_7O_{24}].4H_2O\}$, $MoOCl_4$, $MoO_2Cl_2$, $MoO_2Br_2$, and $Mo_2O_3Cl_6$. Of those, molybdenum trioxide or a hydrate thereof, a molybdic acid, a molybdic acid alkali metal salt, ammoniummolybdate, and the like, which are easily available, are preferred.

The molybdenum amine is a salt of the hexavalent molybdenum compound such as molybdenum trioxide, molybdic acid ($H_2MoO_4$), or a molybdic acid salt, and the primary or secondary amine. Although a production method therefor is not particularly limited, the molybdenum amine can be obtained by, for example, having the hexavalent molybdenum compound and the primary or secondary amine react with each other in a temperature range from room temperature to 100° C. as described in JP 61-285293A. With regard to a reaction ratio between the hexavalent molybdenum compound and the primary or secondary amine, the number of moles of the amine is 0.2 to 2.0, preferably 0.4 to 1.5, more preferably 0.5 to 1.2 with respect to 1 atom of molybdenum. When the reaction ratio is less than 0.2, its solubility in a lubricating oil is insufficient and hence the molybdenum amine is separated and precipitates at low temperature in some cases. When the reaction ratio exceeds 2.0, its suitability for a sealant may be insufficient.

When a molybdenum-containing antioxidant is used as the component (C) of the lubricating oil composition for an internal combustion engine of the present invention, the molybdenum content in the lubricating oil composition for an internal combustion engine, which is not particularly limited, is preferably 1,000 ppm by mass or less, more preferably 700 ppm by mass or less. When the molybdenum concentration exceeds 1,000 ppm by mass, an effect commensurate with the addition amount cannot be expected. In addition, the high concentration may be responsible for high-temperature deposits. It should be noted that one kind of component (C) may be used alone, or two or more kinds thereof may be used in combination.

A phosphorus content in the lubricating oil composition for an internal combustion engine of the present invention is 50 ppm by mass to 1,000 ppm by mass, preferably 200 ppm by mass to 1,000 ppm by mass, more preferably 200 ppm by mass to 800 ppm by mass, still more preferably 300 ppm by mass to 800 ppm by mass, most preferably 400 ppm by mass to 800 ppm by mass. When the phosphorus content with respect to the total amount of the lubricating oil composition for an internal combustion engine is less than 50 ppm by mass, its wear-preventing effect and oxidation-preventing effect become insufficient. When the content exceeds 1,000 ppm by mass, a reduction in activity of an exhaust gas-purifying catalyst is apt to occur.

Although the ratio between component (B) and component (C) containing phosphorus such as zinc dithiophosphate in the lubricating oil composition for an internal combustion engine of the present invention is not particularly limited, the phosphorus content ratio "(B)/(C)" is preferably 9/91 to 91/9, more preferably 9/91 to 38/62, still more preferably 20/80 to 30/70 in consideration of balance between both the effects, i.e., the wear-preventing effect and the oxidation-preventing effect.

The lubricating oil composition for an internal combustion engine of the present invention does not negate the addition of any known lubricating oil additive, and an anti-wear agent, a friction modifier, a metal-based detergent, an ashless dispersant, a nonmetallic antioxidant, a viscosity index improver, a pour point depressant, a rust inhibitor, a corrosion inhibitor, an extreme-pressure additive, an anti-foaming agent, a metal deactivator, an emulsifier, a demulsifier, an antimold, or the like except the components to be blended into the lubricating oil composition of the present invention may be added depending on intended use to such an extent that the effect of the present invention is not impaired.

Examples of an anti-wear agent other than the component (B) and component (C) include sulfur-based additives such as a sulfurized oil and fat, olefin polysulfide, and dibenzyl sulfide and phosphorus-based compounds such as monooctyl phosphate, tributyl phosphate, triphenyl phosphite, tributyl phosphite, and a thiophosphoric acid ester. Of those, an anti-wear agent free of phosphorus is preferably used.

Examples of the friction modifier include: higher alcohols such as oleyl alcohol and stearyl alcohol; fatty acids such as oleic acid and stearic acid; esters such as oleyl glycerine ester, stearyl glycerine ester, and lauryl glycerine ester; amides such as lauryl amide, oleyl amide, and stearyl amide; amines such as laurylamine, oleylamine, and stearylamine; and ethers such as lauryl glycerine ether and oleyl glycerine ether. Such friction modifier is blended in an amount of preferably 0.1 mass % to 5 mass %, more preferably 0.2 mass % to 3 mass % with respect to the component (A).

Examples of the metal-based detergent include sulfonates, phenates, salicylates, and phosphates of calcium, magnesium, and barium, and perbasic salts thereof. Of those, perbasic salts are preferred. Of the perbasic salts, a perbasic salt having a total basic number (TBN) of 30 mg KOH/g to 500 mg KOH/g is more preferable. Such metal-based detergent is blended in an amount of preferably 0.5 mass % to 10 mass %, more preferably 1 mass % to 8 mass % with respect to the component (A). A metal-based detergent free of phosphorus is preferably used.

Examples of the ashless dispersant include succinimide, a succinic acid ester, and benzylamine to each of which an alkyl group or an alkenyl group has been added and each of which has a weight-average molecular weight of about 500 to 3,000, and boron-denatured products thereof. Such ashless dispersant is blended in an amount of preferably 0.5 mass % to 10 mass %, more preferably 1 mass % to 8 mass % with respect to the component (A).

Examples of the nonmetallic antioxidant include: phenol-based antioxidants such as 2,6-ditertiary butylphenol (hereinafter, tertiary butyl is abbreviated as t-butyl), 2,6-di-t-butyl-4-methylphenol, 2,6-di-t-butyl-4-ethylphenol, 2,4-dimethyl-6-t-butylphenol, 4,4'-methylene bis(2,6-di-t-butylphenol), 4,4'-bis(2,6-di-t-butylphenol), 4,4'-bis(2-methyl-6-t-butylphenol), 2,2'-methylene bis(4-methyl-6-t-butylphenol), 2,2'-methylene bis(4-ethyl-6-t-butylphenol), 4,4'-butylidene bis(3-methyl-6-t-butylphenol), 4,4'-isopropylidene bis(2,6-di-t-butylphenol), 2,2'-methylene bis(4-methyl-6-cyclohexylphenol), 2,2'-methylene bis(4-methyl-6-nonylphenol), 2,2'-isobutylidene bis(4,6-dimethylphenol), 2,6-bis(2'-hydroxy-3'-t-butyl-5'-methylbenzyl)-4-methylphenol, 3-t-butyl-4-hydroxyanisole, 2-t-butyl-4-hydroxyanisole, stearyl 3-(4-hydroxy-3,5-di-t-butylphenyl)propionate, oleyl 3-(4-hydroxy-3,5-di-t-butylphenyl)propionate, dodecyl 3-(4-hydroxy-3,5-di-t-butylphenyl)propionate, decyl 3-(4-hydroxy-3,5-di-t-butylphenyl)propionate, octyl 3-(4-hydroxy-3,5-di-t-butylphenyl)propionate, tetrakis{3-(4-hydroxy-3,5-di-t-butylphenyl)propionyl oxymethyl}methane, 3-(4-hydroxy-3,5-di-t-butylphenyl)propionic acid glycerine monoester, ester of 3-(4-hydroxy-3,5-di-t-butylphenyl)propionic acid and glycerine monooleyl ether, 3-(4-hydroxy-3,5-di-t-butylphenyl)propionic acid butylene glycol diester, 3-(4-hydroxy-3,5-di-t-butylphenyl)propionic acid thiodiglycol diester, 4,4'-thio bis(3-methyl-6-t-butylphenol), 4,4'-thio bis(2-methyl-6-t-butylphenol), 2,2'-thio bis(4-methyl-6-t-butylphenol), 2,6-di-t-butyl-α-dimethylamino-p-cresol, 2,6-di-t-butyl-4-(N,N'-dimethylaminomethylphenol), bis(3,5-di-t-butyl-4-hydroxybenzyl)sulfide, tris{(3,5-di-t-butyl-4-hydroxyphenyl)propionyl-oxyethyl}isocyanurate, tris(3,5-di-t-butyl-4-hydroxyphenyl)isocyanurate, 1,3,5-tris(3,5-di-t-butyl-4-hydroxybenzyl)isocyanurate, bis{2-methyl-4-(3-n-alkylthiopropionyloxy)-5-t-butylphenyl}sulfide, 1,3,5-tris(4-t-butyl-3-hydroxy-2,6-dimethylbenzyl)isocyanurate, tetraphthaloyl-di-(2,6-dimethyl-4-t-butyl-3-hydroxybenzyl sulfide), 6-(4-hydroxy-3,5-di-t-butyl anilino)-2,4-bis(octylthio)-1,3,5-triazine, 2,2-thio-{diethyl-bis-3-(3,5-di-t-butyl-4-hydroxyphenyl)}propionate, N,N'-hexamethylene bis(3,5-di-t-butyl-4-hydroxy-hydrocinnamide), 3,5-di-t-butyl-4-hydroxy-benzyl-phosphate diester, bis(3-methyl-4-hydroxy-5-t-butylbenzyl)sulfide, 3,9-bis[1,1-dimethyl-2-{β-(3-t-butyl-4-hydroxy-5-methylphenyl) propionyloxy}ethyl]-2,4,8,10-tetraoxaspiro[5,5]undecane, 1,1,3-tris(2-methyl-4-hydroxy-5-t-butylphenyl)butane, 1,3,5-trimethyl-2,4,6-tris(3,5-di-t-butyl-4-hydroxybenzyl)benz ene, and bis{3,3'-bis-(4'-hydroxy-3'-t-butylphenyl)butyric acid}glycol ester; naphthylamine-based antioxidants such as 1-naphthylamine, phenyl-1-naphthylamine, p-octylphenyl-1-naphthylamine, p-nonylphenyl-1-naphthylamine, p-dodecylphenyl-1-naphthylamine, and phenyl-2-naphthylamine; phenylenediamine-based antioxidants such as N,N'-diisopropyl-p-phenylenediamine, N,N'-diisobutyl-p-phenylenediamine, N,N'-diphenyl-p-phenylenediamine, N,N'-di-β-naphthyl-p-phenylenediamine, N-phenyl-N'-isopropyl-p-phenylenediamine, N-cyclohexyl-N'-phenyl-p-phenylenediamine, N-1,3-dimethylbutyl-N'-phenyl-p-phenylenediamine, dioctyl-p-phenylenediamine, phenylhexyl-p-phenylenediamine, and phenyloctyl-p-phenylenediamine; diphenylamine-based antioxidants such as dipyridylamine, diphenylamine, p,p'-di-n-butyldiphenylamine, p,p'-di-t-butyldiphenylamine, p,p'-di-t-pentyldiphenylamine, p,p'-dioctyldiphenylamine, p,p'-dinonyldiphenylamine, p,p'-didecyldiphenylamine, p,p'-didodecyldiphenylamine, p,p'-distyryldiphenylamine, p,p'-dimethoxydiphenylamine, 4,4'-bis(4-α,α-dimethylbenzoyl) diphenylamine, p-isopropoxydiphenylamine, and dipyridylamine; and phenothiazine-based antioxidants such as phenothiazine, N-methylphenothiazine, N-ethylphenothiazine, 3,7-dioctylphenothiazine, phenothiazine carboxylic acid ester, and phenoselenazine. The blending amount of such nonmetallic antioxidant is preferably 0.01 mass % to 5 mass %, more preferably 0.05 mass % to 4 mass % with respect to the component (A). Of those, a nonmetallic antioxidant free of phosphorus is preferably used.

Examples of the viscosity index improver include a poly(C1 to C18)alkyl(meth)acrylate, a hydroxyethyl(meth)acrylate/(C1 to C18)alkyl(meth)acrylate copolymer, a diethylaminoethyl(meth)acrylate/(C1 to C18)alkyl(meth)acrylate copolymer, an ethylene/(C1 to C18)alkyl(meth)acrylate copolymer, polyisobutylene, a polyalkylstyrene, an ethylene/propylene copolymer, a styrene/maleic acid ester copolymer, and a styrene/isoprene hydrogenated copolymer. Alternatively, a dispersion-type or multi-functional viscosity index improver to which dispersing performance has been imparted may be used. Its weight-average molecular weight is about 10,000 to 1,500,000, preferably about 20,000 to 500,000.

Such viscosity index improver is blended in an amount of preferably 0.1 mass % to 20 mass %, more preferably 0.3 mass % to 15 mass % with respect to the component (A).

Examples of the pour point depressant include a polyalkyl (meth)acrylate, a polyalkylstyrene, a polystyrene-(meth) acrylate, a polyvinyl acetate, and a polyethylene-vinyl acetate. Its weight-average molecular weight is about 1,000 to 100,000, preferably about 5,000 to 50,000. Such pour point depressant is blended in an amount of preferably 0.005 mass % to 3 mass %, more preferably 0.01 mass % to 2 mass % with respect to the component (A).

Examples of the rust inhibitor include sodium nitrite, an oxidized paraffin wax calcium salt, an oxidized paraffin wax magnesium salt, a beef tallow fatty acid alkali metal salt, alkaline earth metal salt, or amine salt, an alkenyl succinic acid or an alkenyl succinic acid half ester (the molecular weight of the alkenyl group is about 100 to 300), a sorbitan monoester, nonylphenol ethoxylate, and calcium salt of lanolin fatty acid. Such rust inhibitor is blended in an amount of preferably 0.01 mass % to 3 mass %, more preferably 0.02 mass % to 2 mass % with respect to the component (A).

Examples of the corrosion inhibitor include benzotriazole, benzimidazole, benzothiazole, benzothiadiazole, and a tetraalkylthiuram disulfide. Such corrosion inhibitor is blended in an amount of preferably 0.01 mass % to 3 mass %, more preferably 0.02 mass % to 2 mass % with respect to the component (A).

Examples of the anti-foaming agent include polydimethylsilicone, trifluoropropylmethylsilicone, colloidal silica, a polyalkyl acrylate, a polyalkyl methacrylate, an alcohol ethoxy/propoxylate, a fatty acid ethoxy/propoxylate, and a sorbitan partial fatty acid ester. Such anti-foaming agent is blended in an amount of preferably 0.001 mass % to 0.1 mass %, more preferably 0.001 mass % to 0.01 mass % with respect to the component (A).

An internal combustion engine in which the lubricating oil composition for an internal combustion engine of the present invention can be used is not particularly limited as long as the engine is used as an internal combustion engine. Examples thereof include a gasoline engine, a diesel engine, a direct injection engine, and a gas engine (liquefied petroleum gas engine).

EXAMPLES

Hereinafter, the present invention is specifically described by way of examples. It should be noted that the terms "%" and "ppm" in the following examples and the like refer to "mass %" and "ppm by mass," respectively unless otherwise stated.

A product of the present invention and a comparative product are described below.

Component (A)

A mineral oil-based high-VI oil having kinematic viscosities of 4.1 $mm^2$/sec (100° C.) and 18.3 $mm^2$/sec (40° C.), and a viscosity index (VI) of 126.

Component (B)

Synthetic examples of the component (B) are described below.

Synthetic Example 1

B-1

A 1,000-ml four-necked flask provided with a stirring machine, a temperature gauge, and a nitrogen-introducing pipe was mounted with a condenser to which a water scrubber had been connected, and then 1.0 mol (110 g) of 1,3-benzenediol, 3.0 mol (460 g) of phosphorus oxychloride, and 0.005 mol (0.5 g) of magnesium chloride were loaded into the resultant reactor. The atmosphere in the reactor was replaced with nitrogen and then its temperature was gradually increased to 100° C. over 5 hours. After the mixture had been aged at the temperature for 2 hours, the pressure in the reactor was reduced and then the temperature was increased to 130° C. Excessive phosphorus oxychloride that had not been consumed in the reaction was removed by distillation. 4.0 moles (376 g) of phenol were added to the reaction liquid and then the mixture was aged. Thus, the reaction was completed. After that, the catalyst was removed by an ordinary method and then the remainder was dried at 140° C. under reduced pressure. Thus, component B-1 represented by a general formula (9) was obtained.

[Chem. 7]

(9)

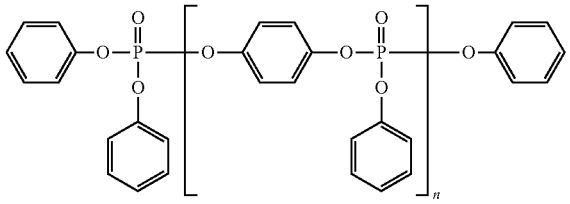

Synthetic Example 2

B-2

Component B-2 represented by a general formula (10) was produced by the same production method as that of component B-1 except that 4,4'-(propane-2,2-diyl)diphenol was used instead of 1,3-benzenediol in the synthesis of component B-1.

[Chem. 8]

(10)

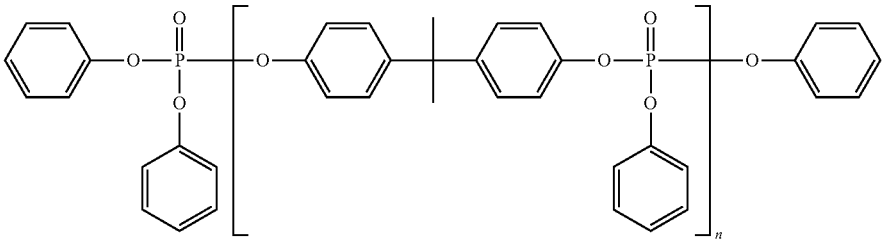

Synthetic Example 3

B-3

A 1,000-ml four-necked flask provided with a stirring machine, a temperature gauge, a dropping funnel and a nitrogen-introducing pipe was mounted with a condenser to which a water scrubber had been connected, and then 2.0 mol (244 g) of 2,6-dimethylphen, and 0.016 mol (1.5 g) of magnesium chloride were loaded into the resultant reactor. The atmosphere in the reactor was replaced with nitrogen and then its temperature was increased to 120° C. 1.0 Mole (153 g) of phosphorus oxychloride was dropped to the reactor at the temperature over 2 hours. After the completion of the dropping, the temperature was increased to 180° C. over 2 hours. Thus, di(2,6-xylyl)phosphorochloridate was obtained. The temperature in the flask was cooled to 20° C., and then 0.5 mol (55 g) of 1,3-benzenediol and 0.016 mol (1.5 g) of magnesium chloride were loaded into the flask. The temperature was increased to 180° C. over 2 hours and then the mixture was aged for 2 hours. After that, the catalyst was removed by an ordinary method and then the remainder was dried at 140° C. under reduced pressure. Thus, component B-3 represented by a general formula (11) was obtained.

[Chem. 9]

(11)

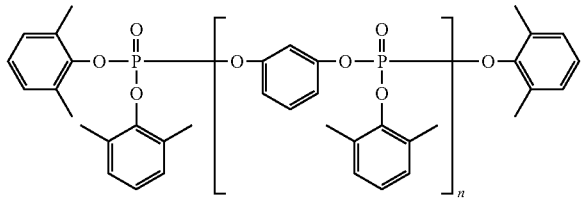

Synthetic Example 4

B-4

Component B-4 represented by a general formula (12) was produced by the same production method as that of component B-1 except that 4,4'-biphenol was used instead of 1,3-benzenediol in the synthesis of component B-1.

[Chem. 10]

(12)

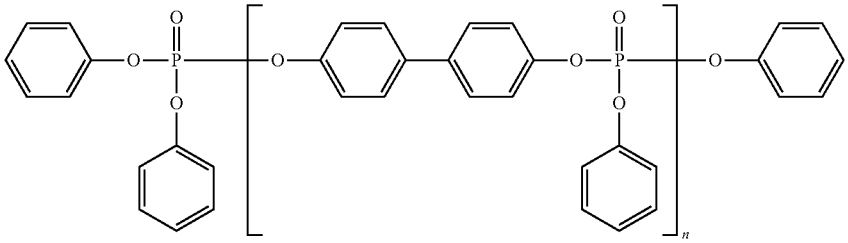

Table 1 below shows the average degree of polymerization of component (B) and the phosphorus content in the compound.

TABLE 1

| Component | Degree of polymerization (molar ratio) | | | Average degree of | Phosphorus content |
|---|---|---|---|---|---|
| (B) | n = 1 | n = 2 | n = 3 to 10 | polymerization | (%) |
| B-1 | 74 | 18 | 8 | 1.4 | 10.9 |
| B-2 | 91 | 8 | 1 | 1.1 | 8.93 |
| B-3 | 95 | 4 | 1 | 1.06 | 9.06 |
| B-4 | 88 | 11 | 1 | 1.1 | 9.53 |

Comparative Product b-1: product of Tokyo Chemical Industry Co., Ltd., product name: triphenyl phosphate (phosphorus content: 9.5%)

Component (C)

C-1: A zinc dithiophosphate (In the general formula (2), the value for a is 0.08, a phosphorus content is 7.8%, and $R^9$ and $R^{10}$ represent a mixture of secondary alkyl groups each having 4 to 6 carbon atoms.)

C-2: A molybdenum dithiocarbamate (In the general formula (3), $R^{11}$ to $R^{14}$ represent a mixture of an isooctyl group and an isotridecyl group (mixing ratio in terms of a molar ratio=1:1), $X^1$ and $X^2$ each represent a sulfur atom, and $X^3$ and $X^4$ each represent an oxygen atom. The molybdenum dithiocarbamate is diluted with a mineral oil so that its molybdenum content may be 10%.)

C-3: A molybdenum dithiophosphate (In the general formula (4), $R^{15}$ to $R^{18}$ each represent an isooctyl group, $X^5$ and $X^6$ each represent a sulfur atom, and $X^7$ and $X^8$ each represent an oxygen atom. The molybdenum dithiophosphate is diluted with a mineral oil so that its molybdenum content may be 9.0%.)

C-4: A molybdenum amine (The molybdenum amine is a reaction product of molybdenum trioxide and a secondary amine (in the general formula (5), $R^{19}$ and $R^{20}$ each represent an isotridecyl group). A reaction ratio "molybdenum trioxide: amine" is 1:1 (molar ratio). Its molybdenum content is 22%.)

Described below are methods of preparing a lubricating oil composition for an internal combustion engine as a product of the present invention and a lubricating oil composition for an internal combustion engine as a comparative invention product used in tests, and conditions for the tests.

A test oil prepared according to the following test oil recipe was used in each of the examples and comparative examples.

| <Test oil recipe> | |
|---|---|
| Component (A) | 100 parts by mass |
| Methacrylate-based viscosity index improver | 3.0 parts by mass |

-continued

| <Test oil recipe> | |
|---|---|
| Calcium salicylate-based detergent | 2.8 parts by mass |
| Succinimide-based dispersant | 5.0 parts by mass |
| Phenol-based antioxidant | 0.25 part by mass |
| Amine-based antioxidant | 0.25 parts by mass |

(Test Conditions)

Wear Resistance Test

The test oil, and the component (B) and the component (C) weighed so as to have concentrations shown in Table 2 were loaded into a 200-ml beaker, and then the mixture was stirred at 90° C. for 1 hour. Thus, a lubricating oil composition for an internal combustion engine was prepared. A wear resistance test was performed with the resultant lubricating oil composition for an internal combustion engine and a high-speed four-ball tester in conformity with ASTM D4172. The wear track diameter (mm) of a ball after the test was measured. A smaller wear track diameter means higher wear resistance.

Oxidation Stability Test Conditions

Test instrument: Thermal analysis system manufactured by TA

Instruments (DSC2920)

Atmospheric pressure: 3.5 MPa

Atmosphere: Oxygen

Flow velocity: 100 ml/min

Test temperature: 180° C.

Table 2 shows the results of the wear resistance test as Test 1 and the results of the oxidation stability test as Test 2. It should be noted that Table 2 shows the concentrations of the component (B) and the component (C) in each lubricating oil composition for an internal combustion engine, and the phosphorus (P) concentration and the molybdenum (Mo) concentration therein. It should be noted that in standards for an engine oil established by the European Automobile Manufacturers Association (ACEA standards), the E7-08 as a standard for a high-load diesel engine requires an oxidation induction period of 35 minutes or more.

TABLE 2

| | Component (B) | | | | | Component (C) | | | | P concentration P ppm | Mo concentration Mo ppm | Test 1 (mm) | Test 2 (Minute(s)) |
|---|---|---|---|---|---|---|---|---|---|---|---|---|---|
| | B-1 | B-2 | B-3 | B-4 | b-1 ppm | C-1 | C-2 | C-3 | C-4 | | | | |
| Example 1 | 917 | | | | | 5,128 | | | | 500 | | 0.50 | 36 |
| Example 2 | 1,834 | | | | | 7,692 | | | | 800 | | 0.45 | 39 |
| Example 3 | 275 | | | | | 1,538 | 3,000 | | | 150 | 300 | 0.57 | 35 |
| Example 4 | 917 | | | | | 3,846 | | 2220 | | 465 | 200 | 0.49 | 39 |
| Example 5 | 917 | | | | | 3,846 | 2,000 | | | 400 | 200 | 0.51 | 38 |
| Example 6 | 917 | | | | | 3,846 | | | 910 | 400 | 200 | 0.53 | 41 |
| Example 7 | 917 | | | | | | 3,000 | | | 100 | 300 | 0.52 | 35 |
| Example 8 | | 1,120 | | | | 5,128 | | | | 500 | | 0.50 | 36 |
| Example 9 | | 1,120 | | | | | 3,000 | | | 100 | 300 | 0.52 | 35 |
| Example 10 | | 1,120 | | | | 3,846 | 2,000 | | | 400 | 200 | 0.51 | 39 |
| Example 11 | | | 1,104 | | | 5,128 | | | | 500 | | 0.49 | 36 |
| Example 12 | | | 1,104 | | | 3,846 | 2,000 | | | 400 | 200 | 0.48 | 40 |
| Example 13 | | | | 1,049 | | 5,128 | | | | 500 | | 0.53 | 36 |
| Comp. Example 1 | | | | | | | | | | | | 0.71 | 24 |
| Comp. Example 2 | | | | | | 2,564 | | | | 200 | | 0.67 | 30 |
| Comp. Example 3 | | | | | | 6,410 | | | | 500 | | 0.64 | 37 |
| Comp. Example 4 | | | | | | 10,256 | | | | 800 | | 0.60 | 40 |
| Comp. Example 5 | | | | | | | | 2,220 | | 65 | 200 | 0.62 | 34 |
| Comp. Example 6 | | | | | | | 3,000 | | | | 300 | 0.67 | 35 |
| Comp. Example 7 | | | | | | | | | 1,365 | | 300 | 0.69 | 36 |
| Comp. Example 8 | | | | | | 6,410 | 3,000 | | | 500 | 300 | 0.63 | 40 |
| Comp. Example 9 | 917 | | | | | | | | | 100 | | 0.54 | 25 |
| Comp. Example 10 | | 1,120 | | | | | | | | 100 | | 0.55 | 23 |
| Comp. Example 11 | | | 1,104 | | | | | | | 100 | | 0.52 | 24 |
| Comp. Example 12 | | | | | 2,105 | 5,128 | | | | 600 | | 0.62 | 36 |

Wear Resistance Test Conditions

Test instrument: Shell-type high-speed four-ball tester

Rotational speed: 1,500 rpm

Load: 490 N

Test temperature: 85° C.

Test time: 60 minutes

Oxidation Stability Test

The test oil, and the component (B) and the component (C) weighed so as to have the concentrations shown in Table 2 were loaded into a 200-ml beaker, and then the mixture was stirred at 90° C. for 1 hour. Thus, a lubricating oil composition for an internal combustion engine was prepared. An oxidation stability test was performed with the prepared lubricating oil composition for an internal combustion engine and a thermal analysis system in conformity with ASTM D5483. An oxidation induction period (minute(s)) required for vigorous oxidation of the test oil to start was measured. A longer oxidation induction period means higher oxidation stability.

INDUSTRIAL APPLICABILITY

The lubricating oil composition for an internal combustion engine of the present invention can be used in any engines used as an internal combustion engines, and can be suitably used in, for example, a gasoline engine, a diesel engine, a direct injection engine, or a gas engine (liquefied petroleum gas engine).

The invention claimed is:

1. A lubricating oil composition for an internal combustion engine, comprising as essential components the following component (A), component (B), and component (C), wherein a phosphorus content of the composition is 50 ppm by mass to 1,000 ppm by mass and a molybdenum content of the composition is less than 1,000 ppm by mass:

Component (A): at least one mineral oil;

Component (B): at least one compound represented by the following formula (1), (1)

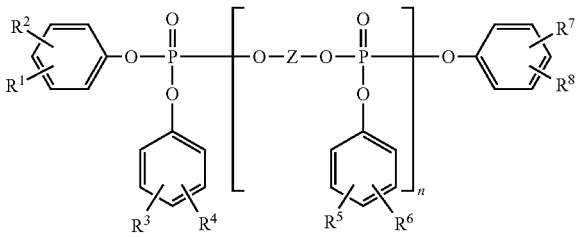

wherein $R^1$, $R^2$, $R^3$, $R^4$, $R^5$, $R^6$, $R^7$ and $R^8$ each independently represent a hydrogen atom or an alkyl group having 1 to 20 carbon atoms, Z represents a hydrocarbon group represented by formula (6), formula (7), or formula (8)

(6)

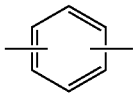

(7)

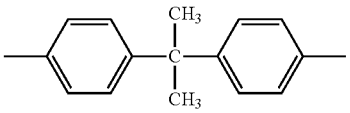

(8)

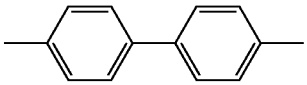

and n represents a number from 1 to 10, wherein an average of n is 1.06 to 1.4; and Component (C): at least one metal-containing antioxidant selected from the group consisting of (i) a molybdenum dithiocarbamate compound represented by the following formula (3), (ii) a molybdenum dithiophosphate compound represented by the following formula (4), (iii) a molybdenum amine obtained by reacting a hexavalent molybdenum compound with a primary or secondary amine represented by the following formula (5), and (iv) a mixture of a zinc dithiophosphate compound represented by the following formula (2) and the molybdenum dithiocarbamate compound represented by the formula (3), the molybdenum dithiophosphate compound represented by the formula (4) and/or the molybdenum amine obtained by reacting the hexavalent molybdenum compound with the primary or secondary amine represented by the formula (5), (2)

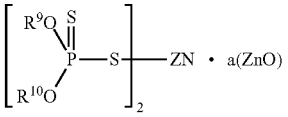

wherein $R^9$ and $R^{10}$ each independently represent a hydrocarbon group having 1 to 20 carbon atoms, and a represents a number of 0 to 1/3;

(3)

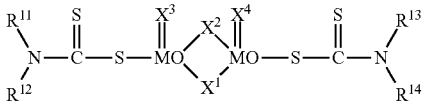

wherein $R^{11}$, $R^{12}$, $R^{13}$ and $R^{14}$ each independently represent a hydrocarbon group having 1 to 20 carbon atoms, and $X^1$, $X^2$, $X^3$ and $X^4$ each independently represent a sulfur atom or an oxygen atom;

(4)

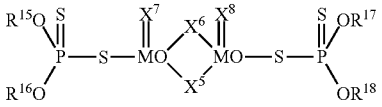

wherein $R^{15}$, $R^{16}$, $R^{17}$ and $R^{18}$ each represent a hydrocarbon group having 1 to 20 carbon atoms, and $X^5$, $X^6$, $X^7$ and $X^8$ each independently represent a sulfur atom or an oxygen atom;

$$R^{19}—NH—R^{20} \quad (5)$$

wherein $R^{19}$ and $R^{20}$ each independently represent a hydrogen atom or a hydrocarbon group having 1 to 40 carbon atoms, provided that $R^{19}$ and $R^{20}$ do not both represent hydrogen atoms.

2. The lubricating oil composition for an internal combustion engine according to claim 1, wherein $R^1$, $R^2$, $R^3$, $R^4$, $R^5$, $R^6$, $R^7$ and $R^8$ in the formula (1) each independently represent a hydrogen atom or a methyl group.

3. The lubricating oil composition for an internal combustion engine according to claim 1, wherein the component (A) is at least one mineral oil selected from the group consisting of a paraffin-based mineral oil, and a naphthene-based mineral oil.

4. The lubricating oil composition for an internal combustion engine according to claim 1, wherein the phosphorus content in the lubricating oil composition is 200 ppm by mass to 1,000 ppm by mass.

5. The lubricating oil composition for an internal combustion engine according to claim 1, further comprising 0.01 mass % to 5 mass % of a nonmetallic antioxidant with respect to the component (A).

6. The lubricating oil composition for an internal combustion engine according to claim 1, further comprising at least one additional component selected from the group consisting of an anti-wear agent, a friction modifier, a metal-based detergent, an ashless dispersant, a viscosity index improver, a pour point depressant, a rust inhibitor, a corrosion inhibitor, and an anti-foaming agent.

7. The lubricating oil composition for an internal combustion engine according to claim 1, wherein the component (C) is (iv) the mixture of the zinc dithiophosphate compound represented by formula (2) and the molybdenum dithiocarbamate compound represented by the formula (3), the molybdenum dithiophosphate compound represented by the formula (4) and/or the molybdenum amine obtained by reacting the hexavalent molybdenum compound with the primary or secondary amine represented by the formula (5), and wherein the phosphorus content ratio between component (B) and component (C) is 9/91 to 91/9.

* * * * *